US005775195A

United States Patent [19]

Haehnel et al.

[11] Patent Number: 5,775,195

[45] Date of Patent: Jul. 7, 1998

[54] ROTARY BRAIDER MACHINE

[75] Inventors: Rudolf Haehnel, Reading, Pa.; Xing Li, Lawrenceville, N.J.

[73] Assignee: Magnatech International, L.P., Sinking Spring, Pa.

[21] Appl. No.: 782,661

[22] Filed: Jan. 14, 1997

[51] Int. Cl.[6] ..... D04C 3/04

[52] U.S. Cl. ..... 87/44; 87/45; 87/46; 87/47; 87/61

[58] Field of Search ..... 87/44, 45, 46, 87/47, 61

[56] References Cited

U.S. PATENT DOCUMENTS

| | | | |
|---|---|---|---|
| 1,457,474 | 6/1923 | Tober | 87/44 |
| 1,615,587 | 1/1927 | Klein et al. | 87/44 |
| 1,725,450 | 8/1929 | Fredrickson | 87/44 |
| 4,034,642 | 7/1977 | Iannucci et al. | 87/48 |
| 4,266,461 | 5/1981 | Molitors | 87/29 |
| 4,275,638 | 6/1981 | DeYoung | 87/48 |
| 4,372,191 | 2/1983 | Iannucci et al. | 87/48 |
| 4,529,147 | 7/1985 | Bull et al. | 242/156.2 |
| 4,535,672 | 8/1985 | Bull et al. | 87/29 |
| 4,535,673 | 8/1985 | Winiasz | 87/29 |
| 4,535,674 | 8/1985 | Bull et al. | 87/29 |
| 4,535,675 | 8/1985 | Bull et al. | 87/29 |
| 4,719,838 | 1/1988 | DeYoung | 87/57 |
| 4,765,220 | 8/1988 | Iannucci et al. | 87/57 |
| 4,788,898 | 12/1988 | Bull | 87/57 |
| 5,099,744 | 3/1992 | Hurst et al. | 87/45 |
| 5,146,836 | 9/1992 | DeYoung | 87/22 |
| 5,158,530 | 10/1992 | Conklin | 602/8 |
| 5,186,092 | 2/1993 | DeYoung | 87/22 |
| 5,220,859 | 6/1993 | DeYoung | 87/57 |
| 5,247,184 | 9/1993 | Kimball | 250/561 |

*Primary Examiner*—William Stryjewski

*Attorney, Agent, or Firm*—Eckert Seamans Cherin & Mellott

[57] ABSTRACT

A rotary braiding machine interweaves strands to form a braid for a work piece, such as a hydraulic hose or the like. A frame has a central axis about which strands of fiber are braided. Inner bobbin-carrier assemblies and outer bobbin-carrier assemblies are carried circumferentially on the frame. The inner bobbin-carrier assemblies are rotatably supported by the frame radially outwardly of the central axis, are separated by recesses, and each supports a strand supply bobbin. Each of the inner bobbin-carrier assemblies has an inner tensioning and control assembly to pay-out a first strand of one or more fibers from its bobbin and to position the first strand in substantially perpendicular relation to the central axis of the frame. The outer bobbin-carrier assemblies are rotatably supported by the frame radially outwardly of the central axis and of the inner array of strand supply bobbins. The outer bobbin-carrier assemblies likewise support strand supply bobbins and form a second circular array, each having an outer tensioning and control assembly to pay-out a second strand of one or more fibers from its bobbin and to manipulate that strand so that it synchronously moves into a corresponding recess in the frame of the machine so that the inner bobbin-carrier assemblies may be circumferentially rotated to pass over the second strand, and out of the corresponding recess so that the inner bobbin-carrier assemblies may be circumferentially rotated so as to pass under the second strand. For minimizing strand tension while achieving the optimum braid angle in the finished product, the outer strands pass through a position substantially perpendicular to the central axis of the machine at the braid point, while passing into and out of the recesses.

9 Claims, 7 Drawing Sheets

ROTARY BRAIDER MACHINE

FIELD OF THE INVENTION

The present invention generally relates to apparatus for braiding reinforcing fibers and the like, and more particularly to rotary braiding apparatus that are capable of interweaving continuous strands of fiber to form a braided cover or structure, e.g., a braided cover for a hydraulic hose.

BACKGROUND OF THE INVENTION

Rotary braiding machines adapted to braid a plurality of strands into a completed braided product or a braided jacket for a core member that is being drawn through the machine are well known in the art. See, for example, U.S. Pat. Nos. 5,247,184; 5,220,859; 5,186,092; 5,158,530; 5,146,836; 4,788,898; 4,719,838; 4,275,638; 4,266,461; 4,535,675; 4,535,674; 4,535,673; 4,535,672; and 4,529,147.

None of the braiding machines developed to date are completely satisfactory. In particular, many of these prior art machines require the tension exerted on the strands to be relatively high as they are being manipulated into a braid. This is particularly disadvantageous in the case where the braid is being formed over a relatively soft work piece, such as an unvulcanized rubber hose or the like.

For example, U.S. Pat. No. 4,275,638, issued to DeYoung, discloses a braiding machine consisting of a plurality of inside and outside sets of circumferentially-spaced bobbins that are mounted in axially-spaced relation on the machine frame and adapted for rotation in opposite directions about a common frame axis. Carriers are provided for carrying both the inside and outside sets of bobbins. The outer carriers are also mounted on the frame in circumferentially-spaced relation, on slotted plates that are rotatable in the same direction as the outside bobbins. In operation, these carriers alternately bridge and clear the slots in the plates, while at the same time, an eyelet for each of the outside bobbins rotates in the same direction as the plates and the outside bobbins. These eyelets are adapted to synchronously move into and out of the slots so as to carry the strands from the outside bobbins, first between, then under, then between again, and then over adjacent inside bobbins as the plates rotate. The eyelets are guided by semi-cylindrical bearing surfaces on the supporting frame and are moved through alternating semi-cylindrical paths of movement by notched gears rotatably supported by the frame. Often, relatively high tensile forces are applied to the individual strands as they are guided by the eyelets. The strands are also maintained at a relatively acute angle with respect to the hose throughout the braiding process.

U.S. Pat. No. 4,535,675, issued to Bull et al., discloses a braiding machine adapted for rotating a set of front strand carriers around the front side of a first table wherein the first table also carries a set of contra-rotating rear strand carriers on its rear side. Strands from the rear carriers pass through arcuate slots in the first table. A second table is disposed in front of the first table, with the tables adapted to rotate in opposite directions. A set of shuttle drive assemblies are mounted on the rear side of the second table. Each drive assembly has two symmetrical and articulated drive arms extending laterally from a single actuator post. Each drive arm follows a cam track and carries an actuator dog for articulated movement into and out of driving engagement with a shuttle drive block actuator slot. In this way, the rear carrier strands, positioned at the inner end of each table slot, pass between front strand carriers and drive assemblies so as to perform the braiding action. Again, it will be noted that the strands are disposed at a relatively acute angle with respect to the hose, and relatively high tensile forces are often exerted upon the individual strands as a result of this arrangement.

As a consequence, there has been a long felt need for a rotary braider capable of interweaving continuous strands of fiber to form a braided cover or structure, but without exerting relatively high tension on the individual strands during the braiding process.

SUMMARY OF THE INVENTION

The foregoing and other deficiencies in the prior art are remedied through the provision of a rotary braiding machine adapted to interweave continuous strands of fiber to form a braided cover or structure for a work piece, the machine comprising a frame having a central axis about which a plurality of strands of fiber are braided, and upon which are circumferentially mounted a plurality of inner bobbin-carrier assemblies and a plurality of outer bobbin-carrier assemblies. The inner bobbin-carrier assemblies are rotatably supported by the frame so as to be disposed radially outwardly of the central axis wherein each of the inner bobbin-carrier assemblies is (i) separated by a recess defined by the frame, and (ii) supports a strand supply bobbin so that the plurality of inner bobbin-carrier assemblies forms a first circular array of strand supply bobbins. Each of the inner bobbin-carrier assemblies comprises an inner tensioning and control assembly that is adapted to pay-out a first strand of fiber from its bobbin and manipulate that first strand so as to position it in substantially perpendicular relation to the central axis of the frame. The plurality of outer bobbin-carrier assemblies are rotatably supported by the frame so as to be disposed radially outwardly of the central axis and the inner circular array of strand supply bobbins. Each of the outer bobbin-carrier assemblies supports a strand supply bobbin so that the plurality of outer bobbin-carrier assemblies forms a second circular array of strand supply bobbins. Each of the outer bobbin-carrier assemblies comprises an outer tensioning and control assembly that is adapted to pay-out a second strand of fiber from its bobbin and to manipulate that strand so that it synchronously moves (i) into a corresponding recess disposed in the frame of the machine so that at least one of the inner bobbin-carrier assemblies may be circumferentially rotated so as to pass over the second strand, and (ii) out of the corresponding recess so that at least one of the inner bobbin-carrier assemblies may be circumferentially rotated so as to pass under the second strand. Advantageously, the outer strands pass through a substantially perpendicular position, relative to the central axis of the machine, while being manipulated into and out of the recesses. Motor means are provided for rotating the inner and the outer bobbin-carrier assemblies relative to one another.

BRIEF DESCRIPTION OF THE DRAWINGS

These and other objects, features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
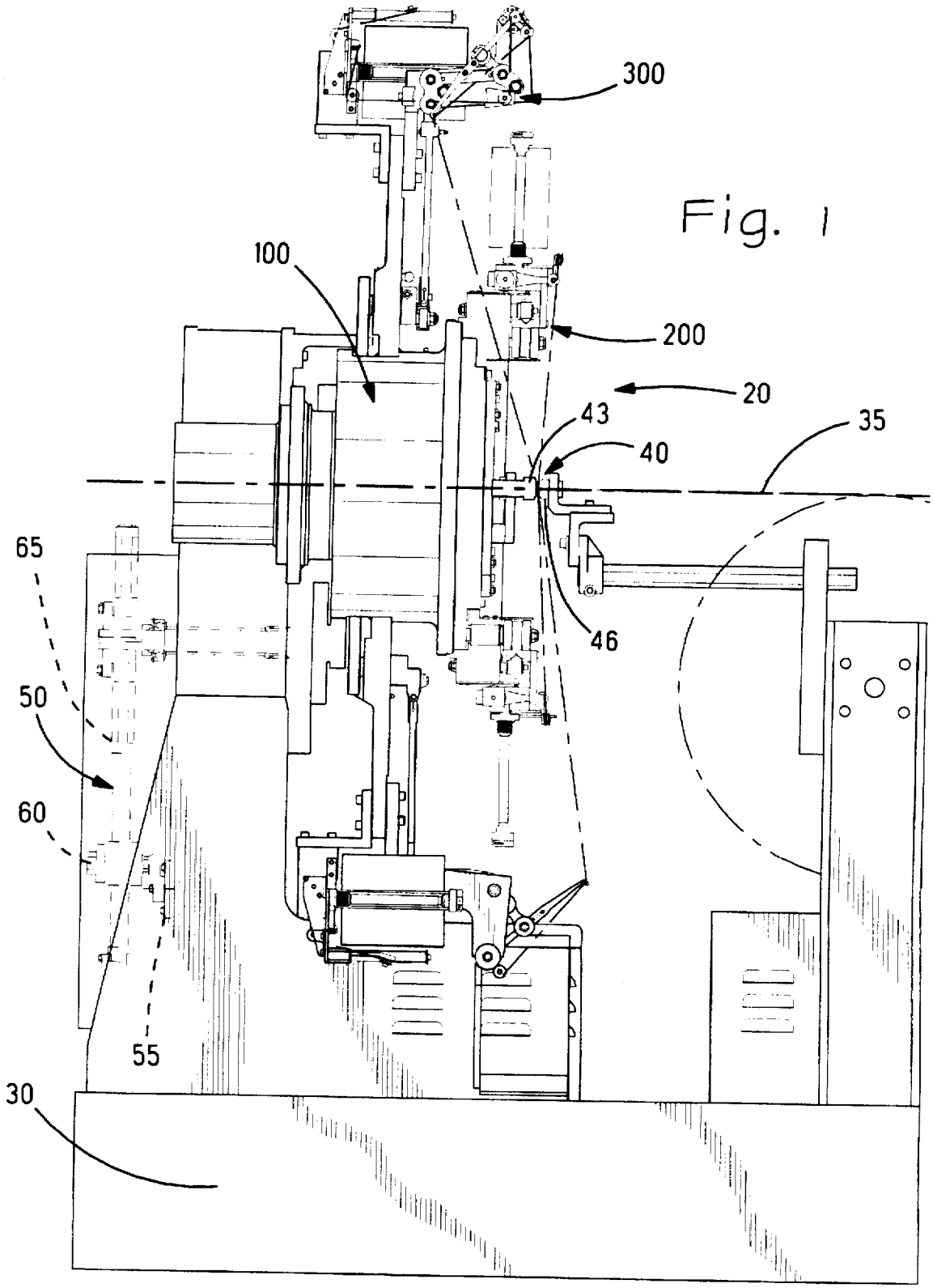
FIG. 1 is a side elevational view of the braiding machine of the present invention showing the relative position and orientation of the strand supply bobbins and strands relative to the braid point of the machine.

Referring to FIG. 1, a rotary braiding machine 20 comprises a frame 30 having a central axis 35 about which a plurality of strand supply bobbins are rotated so as to form a reinforcing braid of those strands about some work piece, such as a hydraulic hose. In this respect, rotary braiding machine 20 is similar to those machines disclosed in U.S. Pat. Nos. 4,034,642; 4,034,643; 4,372,191; and 4,765,220, all issued to Iannucci et al., the disclosures of which patents are hereby incorporated by reference. It will be noted that in each of the foregoing patents, Iannucci et al. disclose rotary braiding machines and components thereof in which the strand supply bobbins are arranged so that each strand forms an angle, relative to a machine central axis, that is substantially less than 90 degrees. While providing adequate braids, these machine designs often require strand tensions to be relatively high. Rotary braiding machine 20 advantageously positions the strand supply bobbins so that each strand is positioned either substantially perpendicular to the point at which the braid is formed or, is manipulated so as to pass through a position that is substantially perpendicular to this so-called braid point, indicated generally at 40 in FIGS. 1, 6 and 7. Braid point 40 is defined between interior hose-guide bushing 43 and exterior hose-guide bushing 46. Unexpectedly, rotary braiding machine 20 has been found to require substantially less strand tension than has been needed in prior art machines.

Rotary braiding machine 20 comprises a drive assembly 50, a rotating assembly 100, a plurality of inner bobbin-carrier assemblies 200, and a plurality of outer bobbin-carrier assemblies 300 all operatively mounted upon frame 30.

More particularly, drive assembly 50 comprises drive motor 55, a drive shaft 60 and a speed control transmission 65. Drive motor 55 may comprise any of the standard industrial motors of the type that are well known in the art. Drive motor 55 is adapted to engage and rotate drive shaft 60 so as to provide a motive force to rotary braiding machine 20. Speed control transmission 65 engages drive shaft 60 so as to provide motive force to a portion of rotating assembly 100, as will hereinafter be disclosed in further detail. Speed control transmission 65 is of the type that is well known for controlling the speed of industrial machinery. For example, speed control transmission 65 may comprise a speed reduction belt and gear system or a geared transmission or the like. It will be understood that drive motor 55 and speed control transmission 65 may be combined into a single unit that is adapted to drive rotary braiding machine 20 without departing from the scope of the present invention.

Figure 2:
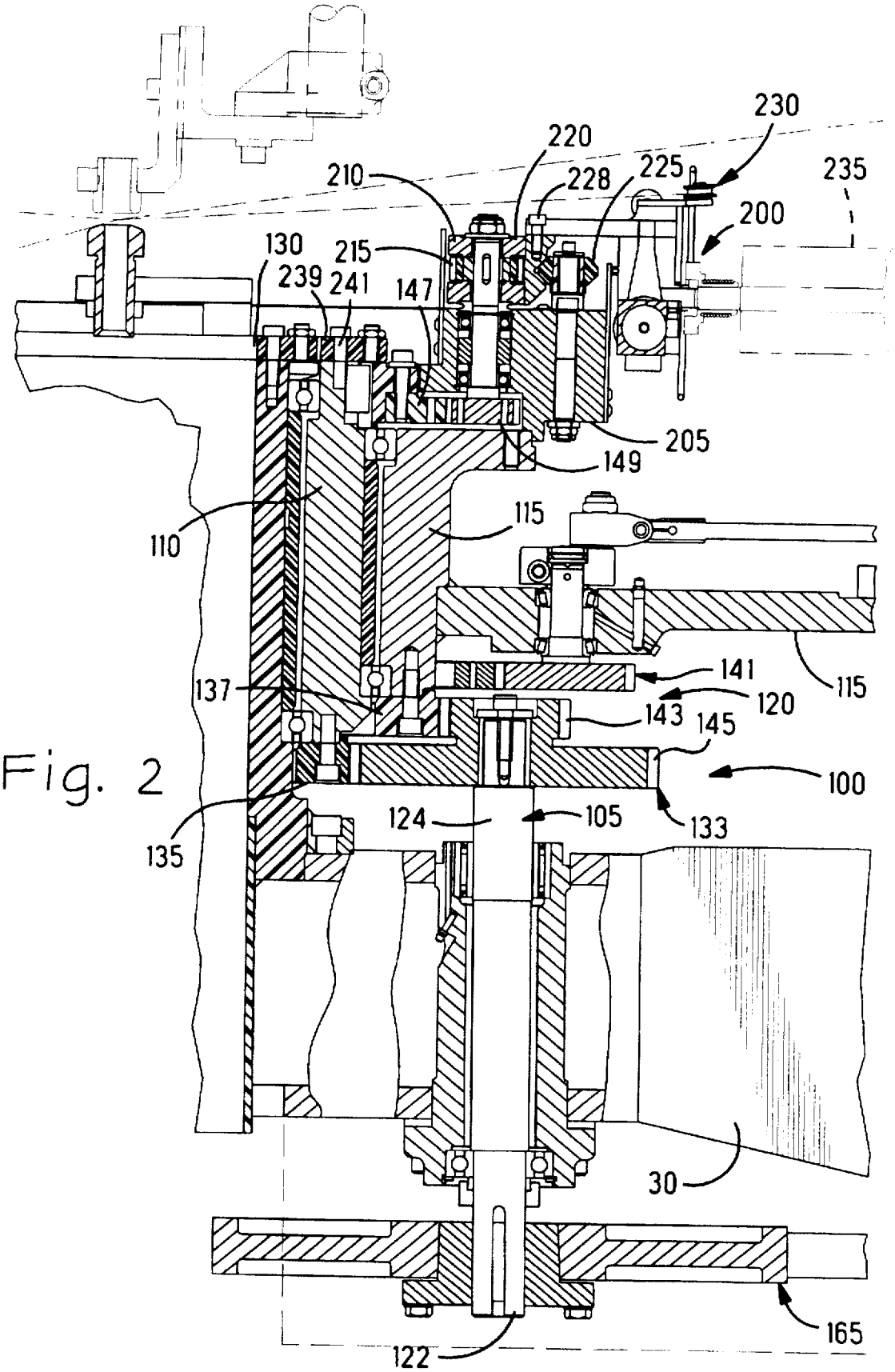
FIG. 2 is a sectional view of a rotating assembly formed in accordance with the present invention.
Figure 5:
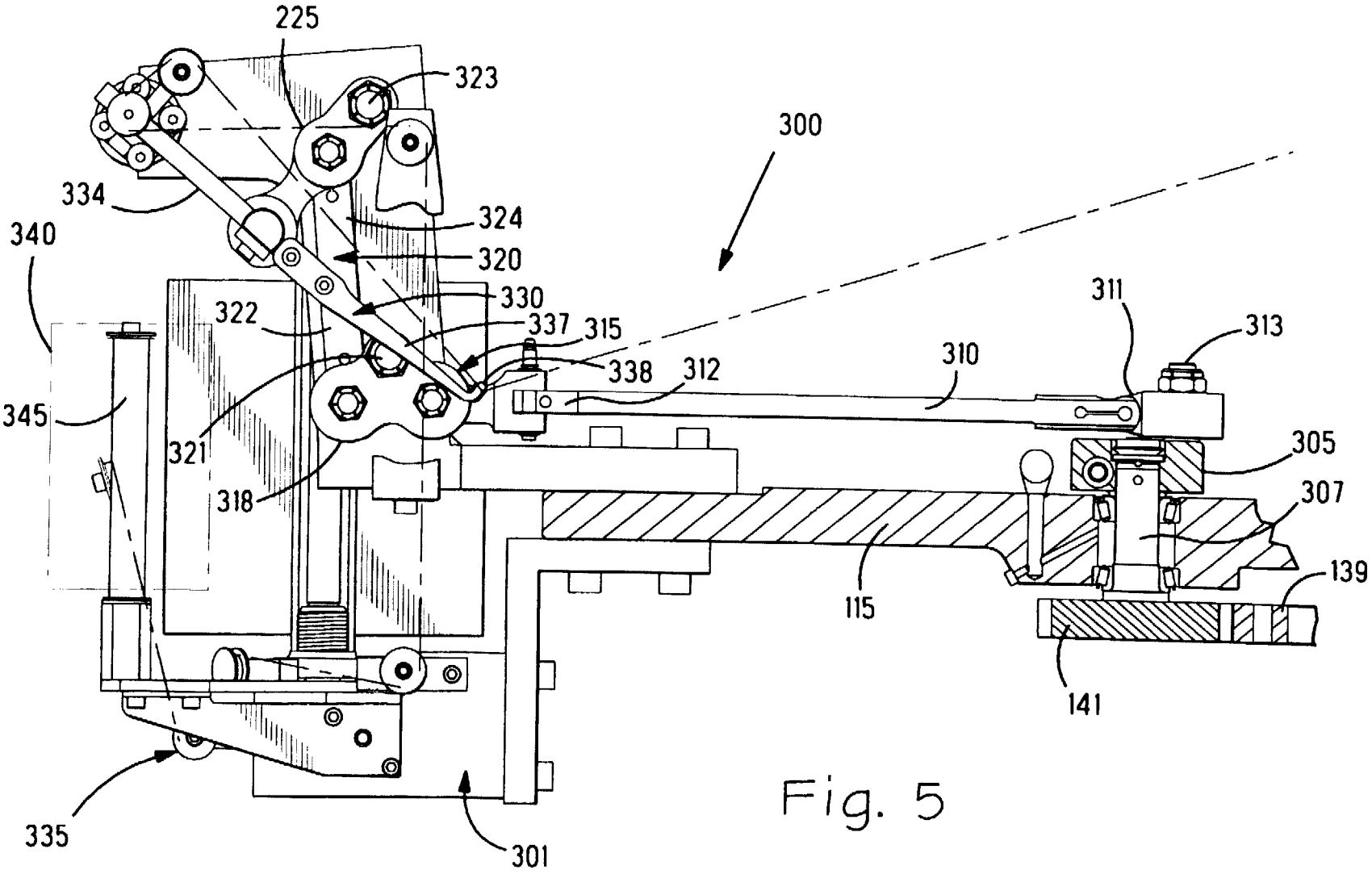
FIG. 5 is a broken-away side view, partially in section, of an outer bobbin-carrier assembly formed in accordance with the present invention.

Referring to FIG. 2, speed control transmission 65 is connected to rotating assembly 100 of rotary braiding machine 20. Rotating assembly 100 comprises a jack shaft 105, a hub 110, a turntable 115, and a gear assembly 120. More particularly, jack shaft 105 comprises a relatively elongate cylindrical shaft having a first end 122 and a second end 124. First end 122 is operatively connected to speed control transmission 65, e.g., via a conventional speed reduction belt and gear system of the type that is well known in the art. Second end 124 of jack shaft 105 engages gear assembly 120, as will hereinafter be disclosed in further detail. Hub 110 and turntable 115 comprise substantially concentric tables that are disposed about a central static trunnion 130 on braiding machine 20. Hub 110 is adapted to support inner bobbin-carrier assembly 200 and outer bobbin-carrier assembly 300 (FIG. 5). Hub 110 and turntable 115 are arranged on braiding machine 20 so as to be rotated, via gear assembly 120, in the same direction relative to trunnion 130, but at substantially different angular rates.

Gear assembly 120 comprises a compound gear 133, hub ring gear 135, turntable ring gear 137, a stationary gear 139, a plurality of pinion gears 141, a timing gear 147, and a plurality of pinion gears 149. Compound gear 133 includes a relatively small diameter first gear 143 that is fixed in coaxial overlying relation with a relatively large gear 145. Second end 124 of jacket shaft 105 is fastened to the center of compound gear 133 so as to be capable of imparting rotative force thereto. Hub ring gear 135 and turntable ring gear 137 are statically mounted upon edge portions of hub 110 and turntable 115, respectively, in coaxial relation to one another and to central axis 35 of braiding machine 20. Compound gear 133 is positioned adjacent to edge portions of hub 110 and turntable 115 so that first gear 143 and second gear 145 of compound gear 133 engagingly mesh with hub ring gear 135 and turntable ring gear 137, respectively.

Stationary gear 139 is disposed on an inner portion of turntable 115. A plurality of pinion gears 141 are each orbitally-positioned on turntable 115 about central axis 35 so as to engagingly mesh with stationary gear 139 and thereby provide motive force to outer bobbin-carrier assembly 300, as will hereinafter be disclosed in further detail. A timing gear 147 is fastened to a corresponding portion of hub 110, so as to engagingly mesh with a second plurality of pinion gears 149. Pinion gears 149 are each disposed on an inner portion of inner bobbin-carrier assembly 200 so as to provide a motive force to inner bobbin-carrier assembly 200, as will hereinafter be disclosed in further detail.

Figure 3:
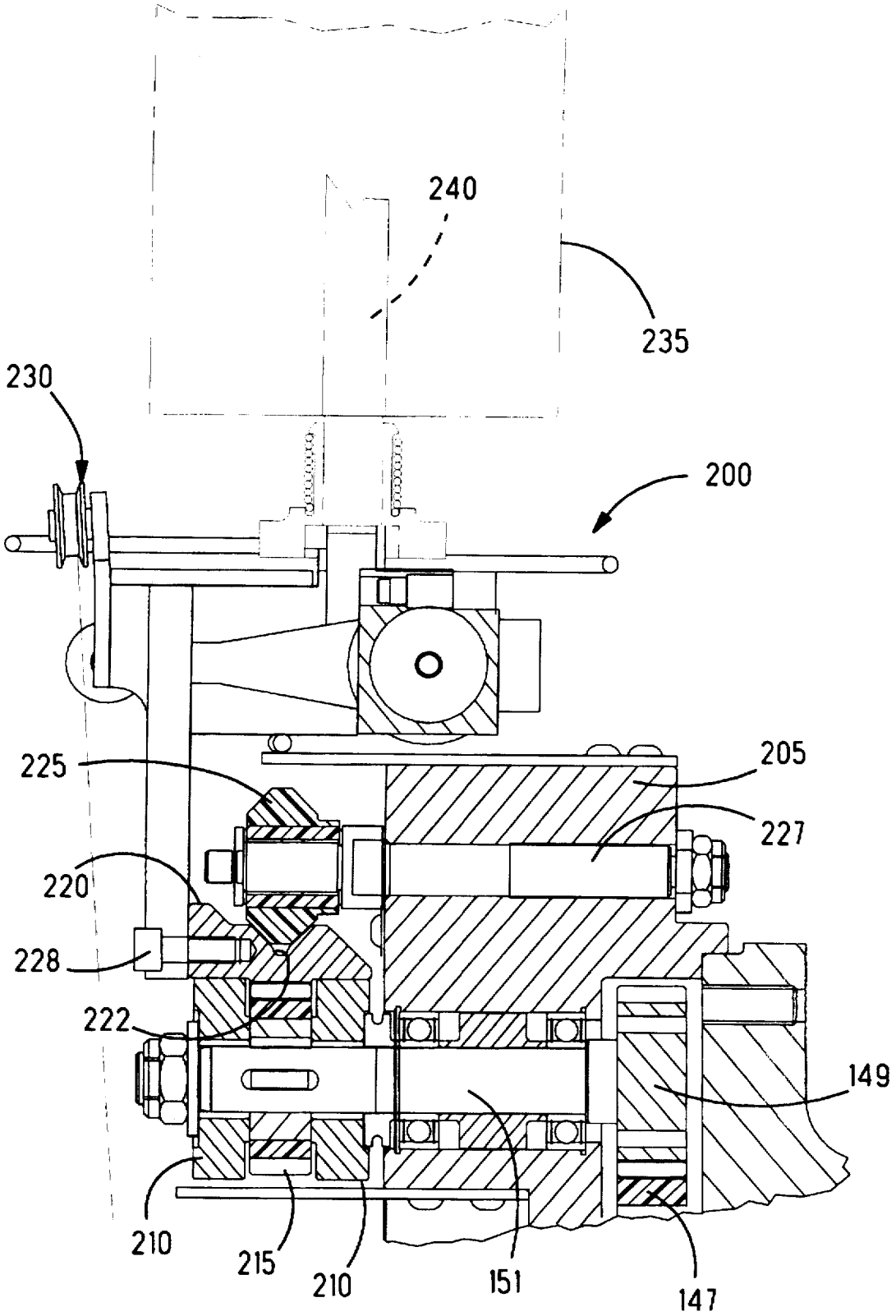
FIG. 3 is a sectional view of an inner bobbin-carrier assembly formed in accordance with the present invention.
Figure 4:
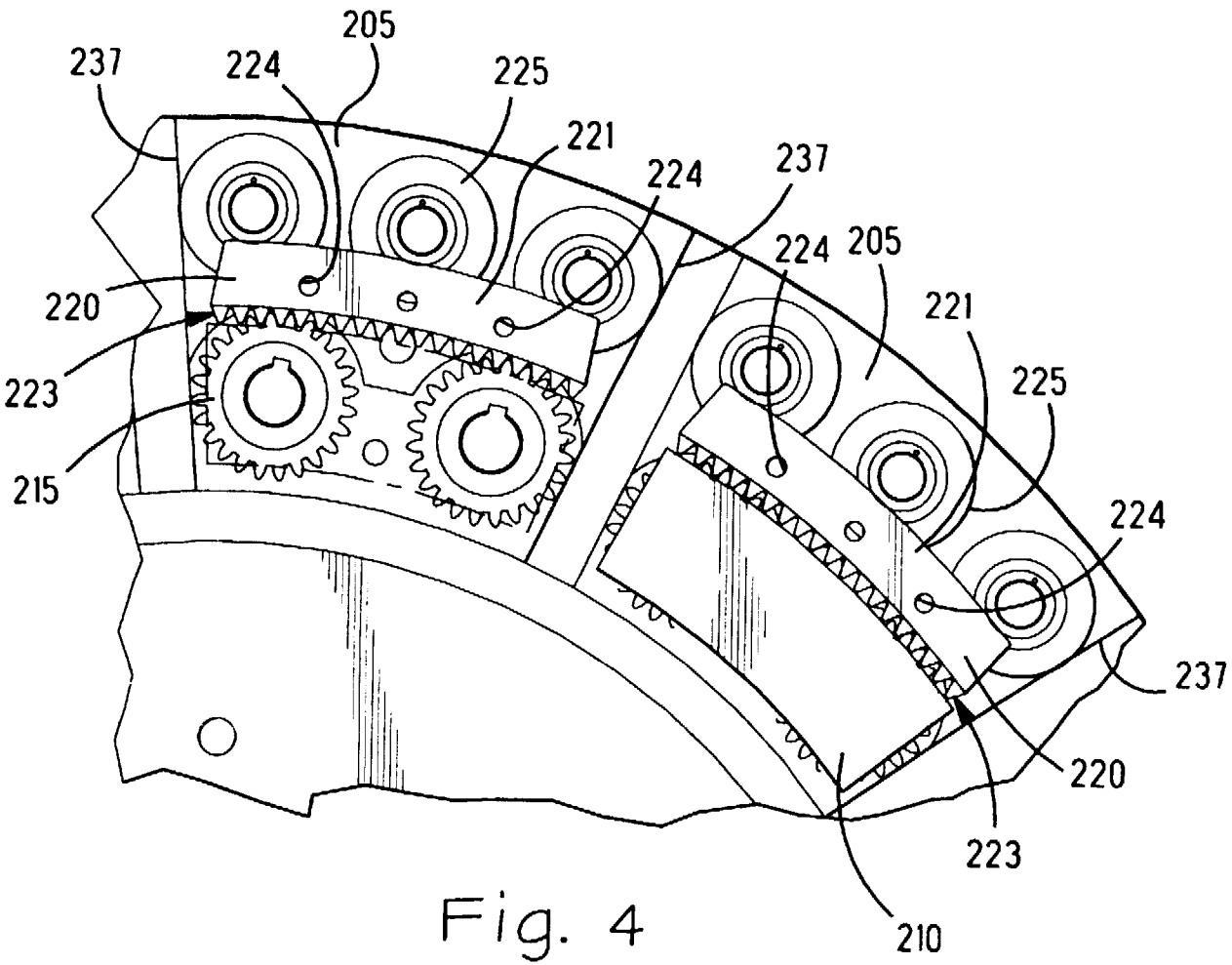
FIG. 4 is a broken-away front elevational view, partially in phantom, showing a portion of the inner bobbin-carrier assembly.

Referring now to FIGS. 1–4, a plurality of inner bobbin-carrier assemblies 200 are positioned in circumferential relation about central axis 35 of frame 30. Each inner bobbin-carrier assembly 200 is rotatably fastened to a driving hub 205, and comprises a support shoe 210, a support shoe pinion gear 215, a carrier support rack 220, rollers 225, an inner tensioning and control assembly 230, and an inner bobbin 235. In one embodiment of the present invention, twelve (12) inner bobbin-carrier assemblies are circumferentially-disposed about frame 30, in circular fashion, so as to define twelve assemblies, each separated by a slot or recess 237 defined in drive hub 205 (FIG. 4). It will be understood that six, eight, twelve, eighteen, twenty-four, or more such inner bobbin-carrier assemblies may be mounted upon frame 30, depending upon the specific requirements of the braided product to be manufactured on rotary braiding machine 20. Driving hub 205 is disposed about central axis 35 in circumferentially spaced relation, and is adapted to support inner bobbin-carrier assembly 200. Driving hub 205 is securely fastened to hub 110 by fastening means that are well known in the art, such as a combination of clamp rings 239 and bolts 241, as shown in FIG. 2.

Each inner bobbin-carrier assembly 200 is motivated by the engagement of timing gear 147 with plurality of pinion gears 149, via a drive shaft 151 (FIG. 3). Each drive shaft 151 projects outwardly from the center of each pinion gear 149, through drive hub 205. Two support shoes 210 (FIGS. 3 and 4) are disposed in confronting, spaced parallel relation to one another on the exterior of each inner bobbin-carrier assembly 200. Support shoes 210 preferably comprise a pair of substantially similar segment-shaped plates that include a pair of bores adapted to receive an end portion of each drive shaft 151. At least a pair of support shoe pinion gears 215 are sandwiched between each confronting pair of support shoes 210, with each pair of support shoe pinion gears 215 being fastened to an end portion of a drive shaft 151. Support shoes 210 are sized and shaped so that a substantial portion of the gear teeth of each support shoe pinion gear 215 project above an upper edge of each support shoe 210 (FIG. 4).

Carrier rack 220 comprises a relatively elongate plate defining a recessed groove 222 on an outer face, a plurality of teeth 223 protruding from an inner face, and a pair of bores 224 opening onto an outer edge portion 221 (FIGS. 3 and 4). Recessed groove 222 is defined by two centrally disposed, acutely angled surfaces that extend into carrier rack 220. Teeth 223 are sized and sequenced so as to be capable of engagingly meshing with support shoe pinion gears 215. Bores 224 are sized and shaped to accept fasteners, such as conventional bolts 228, so as to support both tensioning and control system 230 and inner bobbin 235 from outer edge portion 221 of carrier rack 220 (FIGS. 2 and 3). Each roller 225 is rotatably fastened to driving hub 205, via a roller shaft 227, so as to be positioned in rolling-engagement with the surfaces of carrier rack 220 that define recessed groove 222. Rollers 225 advantageously comprise acutely-angled side surfaces that are shaped to match the surfaces of carrier rack 220 that define recessed groove 222. This construction has been found to significantly improve the operation of inner bobbin-carrier assembly 200 as it rotates about frame 30, due to the enhanced alignment obtained between rollers 225 and recessed groove 222. Of course, it will be understood that carrier rack 220 and tensioning and control assembly 230 may be formed as a single component, if desired, without departing from the scope of the present invention. Rollers 225 are preferably gathered in groups, as seen in FIG. 4. Advantageously, a recess 237 is defined between each adjacent group of rollers 225. Recesses 237 are sized and shaped so as to easily accept a strand from an outer bobbin-carrier assembly 300, as will hereinafter be disclosed in further detail.

Figure 6:
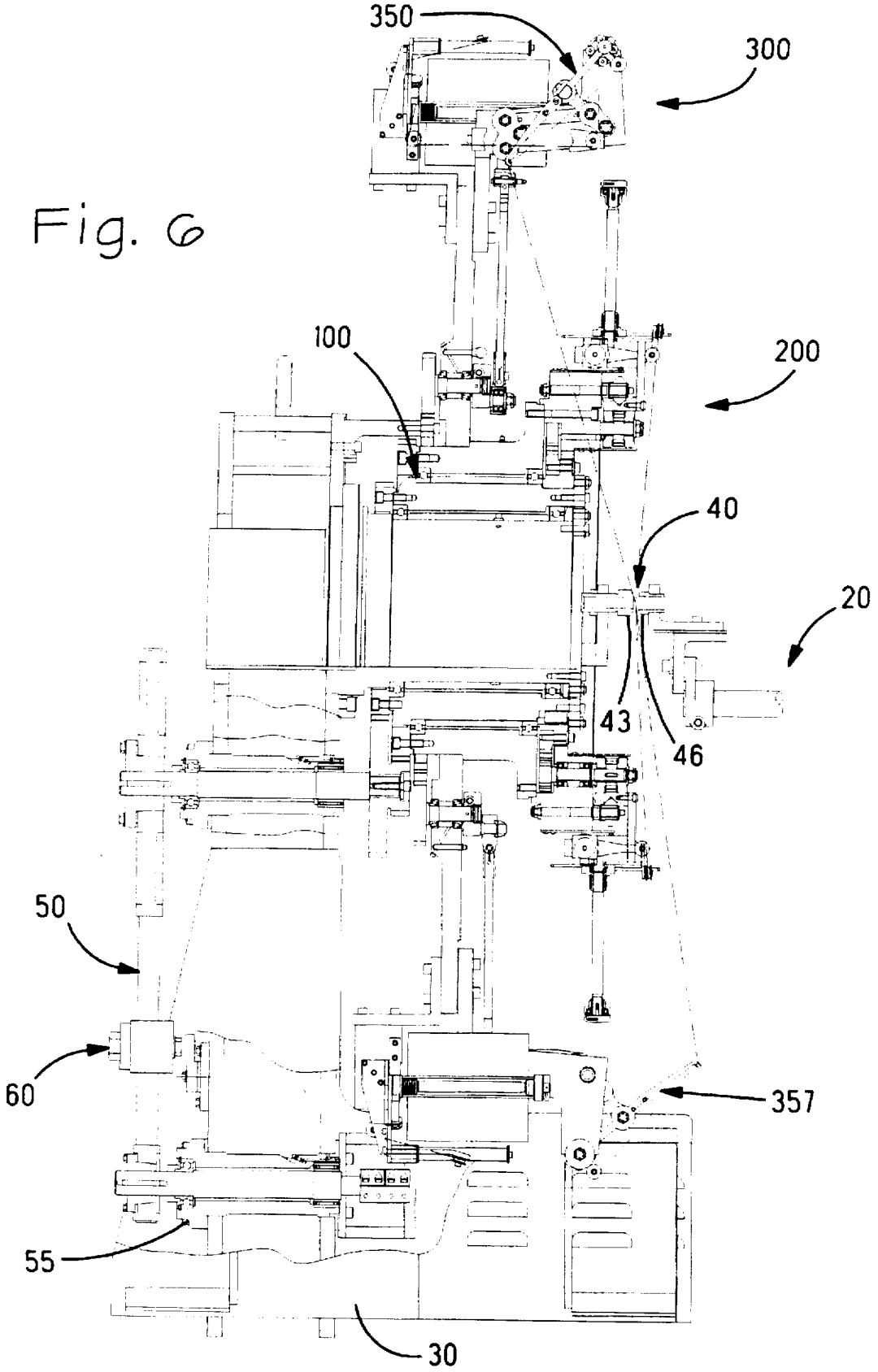
FIG. 6 is a side view of the rotary braider, similar to FIG. 1, showing the position of the inner and outer bobbin-carrier assemblies during a portion of the machine's rotation cycle.
Figure 7:
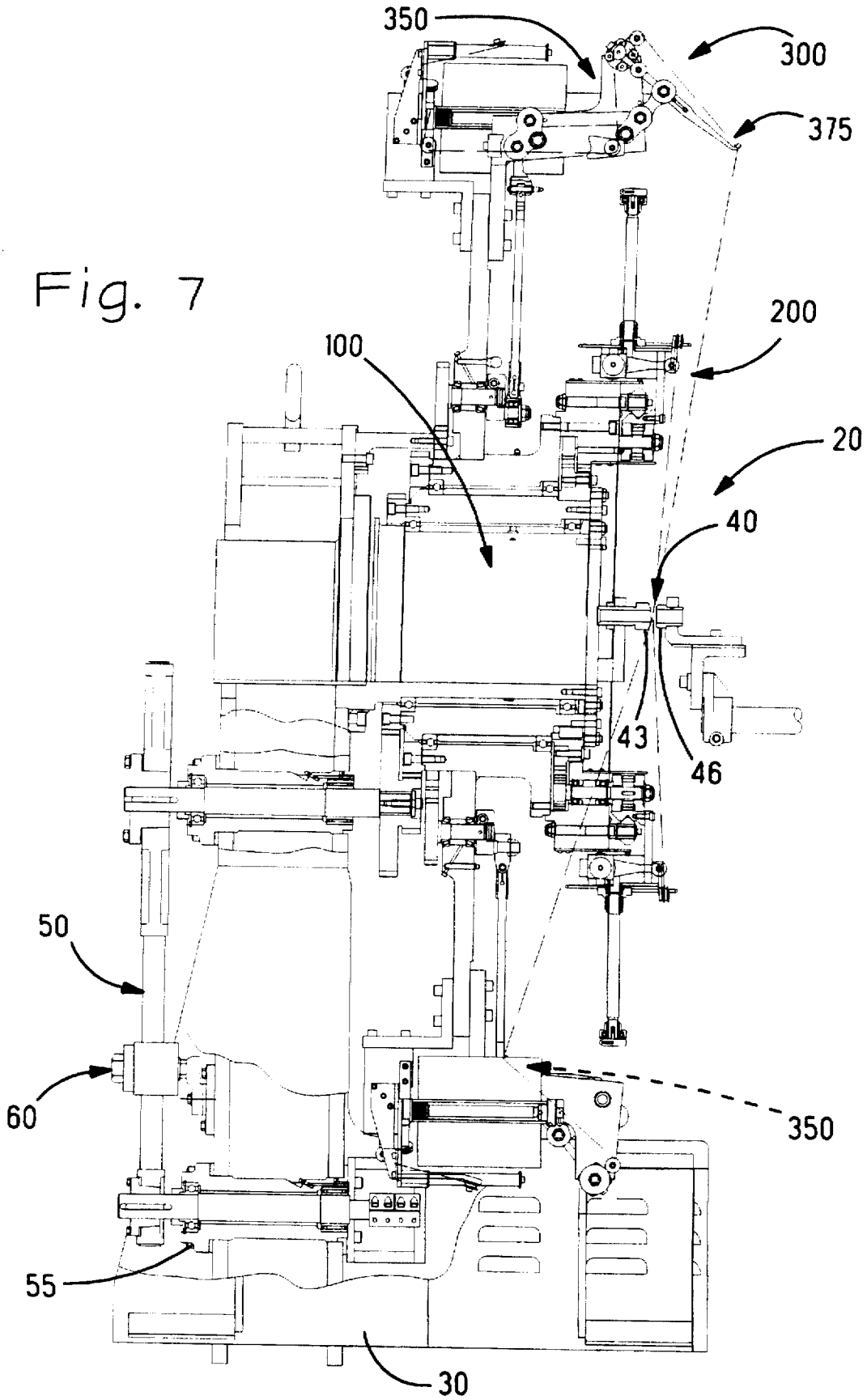
FIG. 7 is a side view of the rotary braider, similar to FIG. 6, showing the position of the inner and outer bobbin-carrier assemblies during a subsequent portion of the machine's rotation cycle.

In one preferred embodiment of the invention, strand tensioning and control assembly 230 comprises a conventional system of pulleys and ratchet mechanisms that are adapted to guide and appropriately control the strand as it leaves inner bobbin 235. It will be appreciated that such pulley and ratchet systems are well known in the art. By way of example, and not of limitation, one such system is disclosed in U.S. Pat. No. 4,765,220, which patent has been incorporated by reference hereinabove. Inner bobbin 235 is mounted upon a shaft 240 so as to be rotatable about the longitudinal axis of shaft 240. Advantageously, shaft 240 is arranged on each inner bobbin-carrier assembly 200 so as to have its longitudinal axis disposed in substantially perpendicular-relation to central axis 35 of frame 30 (FIGS. 1, 6 and 7). This arrangement, in part, allows for the forward positioning of all inner bobbin-carrier assemblies 200 on frame 30, so that they are each disposed radially-outwardly of braid point 40.

Referring now to FIGS. 1 and 5–7, a plurality of outer bobbin-carrier assemblies 300 are positioned on frame 30 in circumferential relation about central axis 35 and inner bobbin-carrier assemblies 200. In one preferred embodiment, twelve (12) outer bobbin-carrier assemblies 300 are circumferentially disposed about frame 30, in circular fashion. It will be understood that 6, 8, 12, 18, 24 or more such outer bobbin-carrier assemblies 300 may be mounted on frame 30. Each outer bobbin-carrier assembly 300 comprises an eccentric crank 305, a first (long) connecting arm 310, a bell crank 315, a second (short) connecting arm 320, a lever arm 325, an actuator arm 330, an outer strand tensioning and control assembly 335, and an outer bobbin 340.

More particularly, and referring to FIG. 5, each eccentric crank 305 is rotatably secured to a pinion gear 141 that is rotatably disposed on turntable 115, via a shaft 307. Each first connecting arm 310 comprises an elongate shaft having proximal end 311 and a distal end 312. Proximal end 311 is pivotally-fastened to a side portion of eccentric crank 305, via a pivot shaft 313, and distal end 312 is pivotally-fastened to bell crank 315. Each bell crank 315 comprises a pair of lobes 317 and 318 that are arranged in eccentric-relation to a bore that passes through bell crank 315. Distal end 312 of first connecting arm 310 is pivotally fastened to lobe 317. Each bell crank 315 is pivotally fastened to a structural portion of each outer bobbin-carrier assembly 300 (shown generally at 301 in FIG. 5) by a fixed-axis pivot shaft 321 that is positioned through the bore in bell crank 315.

Second connecting arm 320 also comprises an elongate shaft having proximal end 322 and a distal end 324, but is relatively shorter than first connecting arm 310. Each second connecting arm 320 is pivotally fastened to lobe 318 of bell crank 315 at proximal end 322 and to lever arm 325 at distal end 324 so as to form a linkage therebetween. Lever arm 325 is pivotally fastened to a structural portion 301 of each outer bobbin-carrier assembly 300 by a fixed-axis pivot shaft 323. The distal end of lever arm 325 is pivotally fastened to a portion of actuator arm 330. Actuator arm 330 preferably comprises a proximal portion 334 and a distal portion 332. Proximal portion 334 is pivotally fastened to a proximal portion of lever arm 325 and is fixed to an end of distal portion 332 of actuator arm 330. Distal portion 337 includes a ceramic eyelet 338 that is adapted to guide and control a strand from outer bobbin 340.

Strand tensioning and control assembly 335 operatively engages the outer end of actuator arm 330. It will be appreciated that outer tensioning and control system 335 may also comprise a conventional pulley and ratchet system, as disclosed hereinabove, that is adapted to guide and appropriately control the strand as it is manipulated by actuator arm 330. Each outer bobbin 340 is positioned adjacent to the proximal end of connecting arm 310 and bell crank 315, and is adapted to pay-out a strand to tensioning and control assembly 335. Outer bobbin 340 is mounted upon a shaft 345 so as to be rotatable about the longitudinal axis of shaft 345. Advantageously, shaft 345 is arranged, on each outer bobbin-carrier assembly 300, so as to have its longitudinal axis arranged in substantially parallel-relation to central axis 35 of frame 30.

Rotary braiding machine 20 is operated in a manner similar to those machines disclosed in U.S. Pat. Nos. 4,034,642 and 4,034,643, the disclosures of which are incorporated hereinabove by reference. More particularly, a strand from each outer bobbin 340 (outer strand) is threaded through its respective outer tensioning and control assembly 335, through eyelet 338 at the distal end of actuator arm 330, and then drawn radially-inwardly to braid point 40 of machine 20. Similarly, a strand from each inner bobbin 235 (inner strand) is threaded through inner tensioning and control assembly 230 and then drawn radially-inwardly to braid point 40 of machine 20 where all of the strands are interwoven so as to form a braid in the conventional manner. Typically, there will be at least eight (8) inner strands and eight (8) outer strands (which can be integral or multi-filament strands), although more or less than that number may be accommodated without departing from the scope of the present invention. In the present invention, the inner strands are arranged so as to project radially inwardly in substantially perpendicular relation to braid point 40 of machine 20, between interior hose-guide 43 and exterior hose-guide 46. For example, each inner strand will form an interior angle, relative to central axis 35, in the range from about 65 to about 100 degrees. The positioning of the inner strands in substantially perpendicular relation to braid point 40 is advantageously provided by the positioning of inner tensioning and control assembly 230 and bobbin 235 on outer edge portion 221 of carrier rack 220, as shown in FIGS. 1, 3, 6, and 7.

Next, as jack shaft 105 is rotated (via drive motor 55 and speed control transmission 65) compound gear 133 engagingly meshes both hub ring gear 135 and turntable ring gear 137 which are positioned adjacent to edge portions of hub 110 and turntable 115. In this way, first gear 143 and second gear 145 engagingly mesh with hub ring gear 135 and turntable ring gear 137, respectfully. As a result, when jack shaft 105 is rotated it imparts a rotative force upon both hub ring gear 135 and turntable ring gear 137. It will be appreciated that hub ring gear 135 and turntable ring gear 137 cause hub 110 and turntable 115 to rotate in the same direction but, due to the difference in diameters of first gear 143 and second gear 145, hub 110 and turntable 115 rotate at different speeds. This difference in speed between hub 110 and turntable 115 allows for the synchronous timing of the reciprocating movement of the strands from the outer bobbin-carrier assemblies 300, as will hereinafter be disclosed in further detail.

Stationary gear 139 is fastened to a portion of frame 30 (FIGS. 2 and 5) and engagingly meshes with each of the plurality of pinion gears 141. In this way, as turntable 115 rotates, stationary gear 139 imparts rotative force to each pinion gear 141 so as to rotate its corresponding eccentric crank 305, via shaft 307. More particularly, during each full rotation of each eccentric crank 305, under the influence of each shaft 307 and pinion gear 141, each first connecting arm 310 is caused to reciprocate, back and forth. Each bell crank 315, in turn, transfers this reciprocating motion to each actuator arm 330 through the linkages formed by each second connecting arm 320 and lever arm 325. As a result of this construction, each full rotation of each eccentric crank 305 causes each actuator arm 330 to move from an innermost position (indicated at 350 in FIGS. 6 and 7) to an outermost position (indicated at 375 in FIGS. 6 and 7). As this occurs, each outer strand is timingly caused to traverse an angular distance, defined between outermost position 375 and innermost position 350. In one embodiment of the present invention, each outer strand traverses an included angle (defined between its outermost position 375 and its innermost position 350) in the range from about 20 to about 60 degrees, such that the strand passes through a substantially-perpendicular position relative to central axis 35. It also should be understood that when each outer strand is disposed at its innermost position 350, a portion of its length will reside within one of recesses 237 in drive hub 205. Advantageously and according to an inventive aspect, as each strand traverses this angular distance, it passes through a position that places the strand in substantially perpendicular relation to braid point 40. A result of this construction is that the tension on the strand is kept to a practical minimum.

It will be appreciated that each actuator arm 330 travels between its innermost position 350 and its outermost position 375 in synchronous-relation to the other actuator arms and to the rotation of each inner bobbin-carrier assembly 200 so as to effect the requisite braiding motion of the inner and outer strands. This is facilitated, in part, by the difference in speeds between hub 110 and turntable 115. It will also be appreciated that the reciprocating rate and rotational timing of travel of each actuator arm 330 will be a function of the physical attributes of pinion gears 141 and stationary gear 139 and the linkages making up outer bobbin-carrier assembly 300, which attributes may be determined by appropriate methods that are well known in the art.

In similar fashion, timing gear 147 (FIG. 2) is fixedly disposed on hub 110 and engagingly meshes with plurality of pinion gears 149. In this way, as hub 110 rotates, timing gear 147 imparts a rotative force on each pinion gear 149. As a result, a rotative force is imparted, via each shaft 151, to each support shoe pinion gear 215 and thereby causes carrier rack 220, and hence, inner bobbin 235 to rotate relative to central axis 35 of machine 20. It will be appreciated that due to the arrangement of timing gear 147 on hub 110, pinion gears 149 are caused to rotate, relative to central axis 35, in a direction opposite to that of turntable 115. As a result of this arrangement, inner bobbin-carrier assemblies 200 rotate in a direction opposite to the direction of rotation of outer bobbin-carrier assemblies 300, but in a synchronous fashion thereto, so as to facilitate the traversing movement of the outer strands into and out of recesses 237 as a result of the reciprocating motion of actuator arms 330. In this way, an individual outer strand is disposed within a particular recess 237 for the time necessary for one or more inner bobbin-carrier assemblies 200 to pass over that strand via the propulsion of each carrier rack 220 by support shoe pinion gears 215, and guided by rollers 225. Similarly, an individual outer strand is disposed above inner bobbin-carrier assemblies 200 for the time necessary for one or more of them to pass under that strand so as to effect the braid.

ADVANTAGES OF THE INVENTION

A number of advantages are obtained by employing a rotary braider construction according to the invention, which avoids the aforementioned problems associated with prior art devices.

A rotary braiding machine is provided that is capable of interweaving continuous strands of metal, inorganic, or organic fiber to form a braided cover or structure, achieving the optimal braid angle in the finished product without exerting relatively high tension on the individual strands during the braiding process.

A rotary braiding machine is provided that positions a plurality of inner strand carrying bobbins on a machine frame so as to be capable of directing the strands from those bobbins radially toward the braid point of the machine, in substantially perpendicular relation to the longitudinal axis of the advancing work, at that braid point.

Also, a rotary braiding machine is provided that positions a plurality of outer strand carrying bobbins concentrically outwardly of a plurality of inner strand carrying bobbins, wherein the strands from these outer bobbins are caused to be manipulated so that they synchronously move into and out of a recesses disposed within the machine frame as the inner bobbins are circumferentially-rotated so as to pass the recesses, wherein the outer strand passes through a substantially perpendicular position, relative to a central axis of the machine, while being manipulated into and out of the recesses.

It is to be understood that the present invention is by no means limited to the precise constructions herein disclosed and shown in the drawings, but also comprises modifications and equivalents within the scope of the appended claims.

What is claimed is:

1. A rotary braiding machine comprising:

a frame having a central axis about which a plurality of strands of fiber are braided;

a plurality of inner bobbin-carrier assemblies rotatably supported by said frame so as to be disposed radially outwardly of said central axis, wherein each of said inner bobbin-carrier assemblies is (i) separated by a recess defined by said frame, and (ii) supports a strand supply bobbin so that said plurality of inner bobbin-carrier assemblies forms a first circular array of strand supply bobbins, each of said inner bobbin-carrier assemblies comprising:

means for paying-out a first strand of fiber; and means for manipulating said first strand so as to position said first strand in substantially-perpendicular relation to said central axis;

a plurality of outer bobbin-carrier assemblies rotatably supported by said frame so as to be disposed radially-outwardly of said central axis and said inner circular array of strand supply bobbins wherein each of said outer bobbin-carrier assemblies supports a strand supply bobbin so that said plurality of outer bobbin-carrier assemblies forms a second circular array of strand supply bobbins, each of said outer bobbin-carrier assemblies comprising:

means for paying-out a second strand of fiber; and means for manipulating said second strand between (i) an innermost position relative to said frame wherein said second strand is positioned in a corresponding one of said recesses in said frame to allow at least one of said inner bobbin-carrier assemblies to pass over said second strand, and, after said at least one of said inner bobbin-carrier assemblies rotates past said recess, (ii) an outermost position wherein at least one of said inner bobbin-carrier assemblies pass under said second strand, wherein said second strand moves between said innermost position and said outermost position in synchronous-relation with the rotation of each inner bobbin-carrier assembly and further wherein said second strand passes through a substantially-perpendicular position, relative to said central axis, while being manipulated between said innermost and said outermost positions; and, means for rotating said inner and said outer bobbin-carrier assemblies relative to one another.

2. A rotary braiding machine according to claim 1 wherein said means for paying-out said first strand comprises a tensioning and control assembly adapted to maintain a minimum tension in said strand of about one pound.

3. A rotary braiding machine according to claim 2 wherein said means for manipulating said first strand comprise a carrier rack and pinion gear assembly rotatably mounted on said frame and adapted to (i) support a ratchet and pulley assembly for providing guidance and control of said first strand as said first strand is paid-out and said inner strand supply bobbin on a portion of said carrier rack so as to position said strand in substantially perpendicular relation to said central axis, and (ii) rotate said ratchet and pulley assembly and said inner strand supply bobbin in a direction opposite to the direction of rotation of said outer strand supply bobbins.

4. A rotary braiding machine according to claim 1 wherein said means for paying-out said second strand comprises a tension and control assembly adapted to maintain a minimum tension in said strand of about one pound.

5. A rotary braiding machine according to claim 4 wherein said tensioning and control assembly is disposed in cooperative relation with an actuator arm having a distal end adapted to slidingly engage and guide said second strand, wherein said actuator arm is operatively connected to a synchronously operative linkage actuated by gear means connected to said means for rotating so as to reciprocatingly drive said distal end of said actuator arm wherein said second strand is caused to traverse an angular distance corresponding to the included angle defined between said outermost position and said innermost position and relative to a braid point defined by the intersection of said first and second strands and said central axis of said frame.

6. A rotary braiding machine according to claim 5 wherein said angular distance defines an included angle in the range from about 20 to about 60 degrees relative to said central axis.

7. A rotary braiding machine according to claim 1 wherein said inner bobbin-carrier assembly is positioned relative to said frame so as to place each of said plurality of inner bobbin-carrier assemblies radially outwardly of said central axis.

8. A rotary braiding machine adapted to interweave continuous strands of fiber to form a braided cover or structure for a work piece, said rotary braiding machine comprising:

a frame having a central axis about which a plurality of strands of fiber are braided;

a plurality of inner bobbin-carrier assemblies rotatably supported by said frame so as to be disposed radially-outwardly of said central axis wherein each of said inner bobbin-carrier assemblies is (i) separated by a recess defined by said frame, and (ii) supports a strand supply bobbin so that said plurality of inner bobbin-carrier assemblies forms a first circular array of strand supply bobbins, each of said inner bobbin-carrier assemblies comprising:

an inner tensioning and control assembly adapted to pay-out a first strand of fiber from said bobbin and to manipulate said first strand so as to position said first strand in substantially perpendicular relation to said central axis;

a plurality of outer bobbin-carrier assemblies rotatably supported by said frame so as to be disposed radially-outwardly of said central axis and said inner circular array of strand supply bobbins wherein each of said outer bobbin-carrier assemblies supports a strand supply bobbin so that said plurality of outer bobbin-carrier assemblies forms a second circular array of strand supply bobbins, each of said outer bobbin-carrier assemblies comprising:

an outer tensioning and control assembly adapted to pay-out a second strand of fiber from said bobbin and to manipulate said second strand between (i) an innermost position relative to said frame wherein said second strand is positioned in a corresponding one of said recesses in said frame to allow at least one of said inner bobbin-carrier assemblies to pass over said second strand, and after said at least one of said inner bobbin-carrier assemblies rotates past said recess, (ii) an outermost position relative to said frame wherein at least one of said inner bobbin-carrier assemblies pass under said second strand, wherein said second outer strand moves between said innermost position and said outermost position in synchronous-relation with the rotation of each inner bobbin-carrier assembly and further wherein said second strand passes through a substantially-perpendicular position, relative to said central axis, while being manipulated between said innermost and said outermost positions; and, means for rotating said inner and said outer bobbin-carrier assemblies relative to one another.

9. A rotary braiding machine comprising:

a frame having a central axis about which a plurality of strands of fiber are braided;

a plurality of inner bobbin-carrier assemblies rotatably supported by said frame so as to be disposed radially outwardly of said central axis, wherein each of said inner bobbin-carrier assemblies (i) is separated by a recess defined in a rotatable portion of said frame, and (ii) support a strand supply bobbin so that said plurality of inner bobbin-carrier assemblies forms a first circular array of strand supply bobbins, each of said inner bobbin-carrier assemblies comprising:

means for paying-out a first strand of fiber; and means for manipulating said first strand so as to position said first strand in substantially-perpendicular relation to said central axis;

a plurality of outer bobbin-carrier assemblies supported by said rotatable portion of said frame so as to be disposed radially-outwardly of said central axis and said inner circular array of strand supply bobbins wherein each of said outer bobbin-carrier assemblies supports a strand supply bobbin so that said plurality of outer bobbin-carrier assemblies forms a second circular array of strand supply bobbins, each of said outer bobbin-carrier assemblies comprising:

means for paying-out a second strand of fiber; and means for manipulating said second strand between (i) an innermost position relative to said frame wherein said second strand is placed in a corresponding one of said recesses to allow at least one of said inner bobbin-carrier assemblies to pass over said second strand and, after said at least one of said inner bobbin-carrier assemblies rotates past said recess, (ii) an outermost position wherein at least one of said inner bobbin-carrier assemblies pass under said second strand, wherein said second strand moves between said innermost position and said outermost position in timed-relation with the rotation of each inner bobbin-carrier assembly and further wherein said second strand passes through a substantially-perpendicular position, relative to said central axis, while being manipulated between said innermost and said outermost positions; and means for rotating (i) said inner bobbin-carrier assemblies and (ii) said outer bobbin-carrier assemblies along with said rotatable portion of said frame, relative to one another.

* * * * *